United States Patent [19]

Driscoll

[11] 3,962,388

[45] June 8, 1976

[54] METHOD OF PRODUCING A FOAM FIBRILLATED WEB

[75] Inventor: Gary L. Driscoll, Boothwyn, Pa.

[73] Assignee: Sun Research and Development Co., Philadelphia, Pa.

[22] Filed: Jan. 2, 1973

[21] Appl. No.: 320,355

[52] U.S. Cl. ..... 264/51; 260/2.5 E; 260/2.5 HA; 264/54; 264/210 R; 264/DIG. 8; 264/DIG. 47; 428/109; 428/136; 428/910

[51] Int. Cl.[2] ..... B29C 25/00; B29D 27/00; B29D 7/24

[58] Field of Search ..... 264/51, 53, 54, DIG. 8, 264/321, DIG. 47, 210 R; 161/252; 260/897 B, 2.5 E, 2.5 HA; 428/109, 136, 131, 910

[56] References Cited

UNITED STATES PATENTS

| | | | |
|---|---|---|---|
| 3,137,611 | 6/1964 | Krolik | 428/131 |
| 3,232,789 | 2/1966 | Pelzek et al. | 161/252 UX |
| 3,248,359 | 4/1966 | Maloney | 260/879 B X |
| 3,300,366 | 1/1967 | Krolik | 428/136 |
| 3,328,227 | 6/1967 | Moseley et al. | 428/136 |
| 3,342,902 | 9/1967 | Peterkin | 161/252 X |
| 3,381,717 | 5/1968 | Tyrrel | 161/252 X |
| 3,403,203 | 9/1968 | Schirmer | 264/DIG. 8 |
| 3,539,666 | 11/1970 | Schirmer | 264/DIG. 8 |
| 3,549,470 | 12/1970 | Greenwald et al. | 264/DIG. 8 |
| 3,562,367 | 2/1971 | Shinohara et al. | 264/54 X |
| 3,562,369 | 2/1971 | Chopra et al. | 264/DIG. 8 |
| 3,576,931 | 4/1971 | Chopra et al. | 264/DIG. 8 |
| 3,611,699 | 10/1971 | Wininger et al. | 264/DIG. 8 |
| 3,645,085 | 2/1972 | Rassart | 264/DIG. 8 |
| 3,702,314 | 11/1972 | Farjon et al. | 260/897 B X |

FOREIGN PATENTS OR APPLICATIONS

| | | | |
|---|---|---|---|
| 1,157,299 | 7/1969 | United Kingdom | 264/54 |
| 1,192,132 | 5/1970 | United Kingdom | 264/54 |

OTHER PUBLICATIONS

"The Naming and Indexing of Chemical Compounds from Chemical Abstracts," Introduction to the subject index of vol. 56, Washington D.C., American Chemical Society, 1962, pp. 12N–15N; 37N–40N; 44N; 45N; 87N–89N; 94N; 95N.

Brydson, J. A., "Plastics Materials," Princeton, N.J., D. Van Nostrand, 1966, pp. 221–224.

Miller, M. L., "The Structure of Polymers," New York, Reinhold, 1966, pp. 286–288; 524–535.

*Encyclopedia of Polymer Science and Technology*, vol. 5, sections "Differential Thermal Analysis," New York, Interscience, 1966, pp. 37–57.

"The Condensed Chemical Dictionary," Eighth edition, revised by Gessner G. Hawley, New York, Van Nostrand Reinhold, 1971, p. 87.

Muus; Laurits T., N. Gerard McCrum; and Frank C. McGraw, "On the Relationship of Physical Properties to Structure in Linbar Polymers of Ethylene and Propylene," In SPE Journal, May, 1959, pp. 368–372.

*Primary Examiner*—Philip Anderson
*Attorney, Agent, or Firm*—J. Edward Hess; Donald R. Johnson; Anthony Potts, Jr.

[57] ABSTRACT

Non-woven fabrics are produced from oriented foam fibrillated webs containing 75 to 98 wt. % polypropylene and 2 to 25 wt. % of an ethylene-vinyl acetate copolymer containing from 2 to 40 wt. % vinyl acetate and 60 to 98 wt. % ethylene. The webs are assembled in a plurality of layers and then bonded by heat and pressure either with or without the presence of an adhesive. In a preferred aspect films especially of polyethylene or ethylene-vinyl acetate copolymers are used as the bonding agent.

4 Claims, 2 Drawing Figures

METHOD OF PRODUCING A FOAM FIBRILLATED WEB

BACKGROUND OF THE INVENTION

In the past there has been considerable effort to find a way of forming fabric-like materials by means other than weaving or knitting. Weaving fabrics is an expensive operation, particularly when the woven material is made of fiber slivers. Woven slit film eliminates the carding or garneting of fibers but still involves the expensive weaving operation. Needle punching of layers of fibrillated films is used for some purposes, but for many purposes the layers are not sufficiently unitized. Bonding together of polypropylene webs by heat and pressure with or without a thermoplastic adhesive results in bond strengths which are less than that desired for most applications.

SUMMARY OF THE INVENTION

The present invention relates to forming non-woven fabrics from a novel foam fibrillated web. This web is formed of a blend of polypropylene and an ethylene-vinyl acetate copolymer. The polypropylene supplies the strength and backbone of the web while the ethylene-vinyl acetate copolymer serves to improve the bonding of the webs when a plurality of layers of such webs are formed into a non-woven fabric. The bond strength of the webs formed from the blend of polypropylene and ethylene-vinyl acetate copolymer is substantially improved as compared with the bond strength of pure polypropylene webs both when the webs are bonded together by heat and pressure and when a thermoplastic adhesive is used. The adhesive may be applied as a dispersion or in the form of one or more films which are layered up with the fibrillated webs prior to bonding. The webs are assembled into a plurality of layers by any suitable means such as simply unrolling some webs onto a carrier belt and cross-lapping some other layers to provide strength across the machine direction of the final non-woven fabric. The assembled layers are finally laminated together using a combination of heat and pressure.

DESCRIPTION OF THE DRAWINGS

In FIG. 1 a blend of polypropylene and ethylene-vinyl acetate is fed to hopper 1 of feed meterer 2, along with whatever blowing agent is required. The blend is fed at a controlled rate from feed meterer 2 to the feed hopper 3 of extruder 4 as free falling pellets 5. Extruder 4 is equipped with a slit die 6 the slit of which is offset from the extruder feed port so as to build up sufficient back pressure to provide for a uniform feed rate across the width of the die. The extrudate is taken up and attenuated by first pair of nip rolls 7,7′. As the extrudate leaves the die it is air quenched by means of an air quench manifold 8 which contains ports directed at the extrudate. A hood 9 is provided to remove the gaseous blowing agent which may contain noxious fumes from the atmosphere. First nip rolls 7,7′ are operated at a rate from 2 to 25 times the rate at which the polymer blend is supplied to the lips of die 6 by extruder 4. This serves to break the foam bubbles as they approach the lips of die 6 within the die or immediately as they leave die 6, whereby a foam fibrillated web 10 of the polymer blend is formed. The foam fibrillated web is fed over heated shoe 11 and drawn by second pair of nip rolls 12,12′. Generally the second pair of nip rolls 12,12′ are driven at a surface speed rate of from 1.5 to 10 times the surface speed rate of first pair of nip rolls 7,7′ to orient and thereby strengthen foam fibrillated web 10. The thus oriented foam fibrillated web 10 is then taken up on take-up reel 13.

In FIG. 2 a reel 14 of foam fibrillated web 15 is fed onto carrier belt 16. A layer of bonding film 17 is fed on top of foam fibrillated web 15 from reel 18. An additional layer of foam fibrillated web 19 is fed from reel 20, supported overhead by means not shown, to lapper 21. Lapper 21 contains a pair of driven nip rolls mounted in a carriage. The nip rolls feed the foam fibrillated web 19 onto bonding film 17 while being moved back and forth across bonding film 17 in the carriage. This results in the foam fibrillated web being laid down at a 45° angle to the machine direction in a double thickness. By varying the width of web 19 almost any desired angle can be obtained. A second reel 22 feeds a foam fibrillated web 23 through lapper 24 onto lapped foam fibrillated web 21 to form two layers of foam fibrillated web 23 each disposed at 45° to the machine direction. An additional layer of bonding film 25 is laid on top of foam fibrillated web 23 from reel 26. A final layer of foam fibrillated web 27 is fed from reel 28 on top of bonding film 25. The entire lay-up of foam fibrillated webs and bonding film is then removed from carrier belt 16 and fed through heated laminating rolls 29,29′ to form non-woven fabric 30 which is taken up on take-up reel 31.

DETAILED DESCRIPTION

Figure 1:
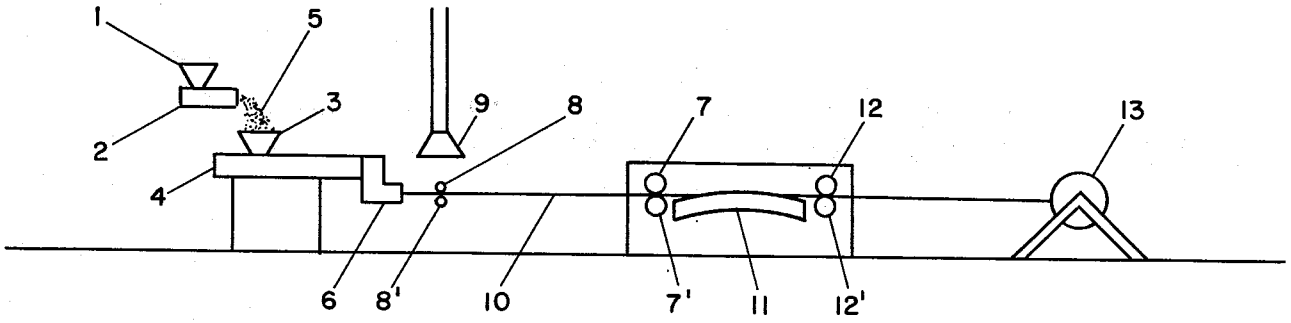
FIG. 1 is a schematic side view of the foam extrusion on fibrillation apparatus.
Figure 2:
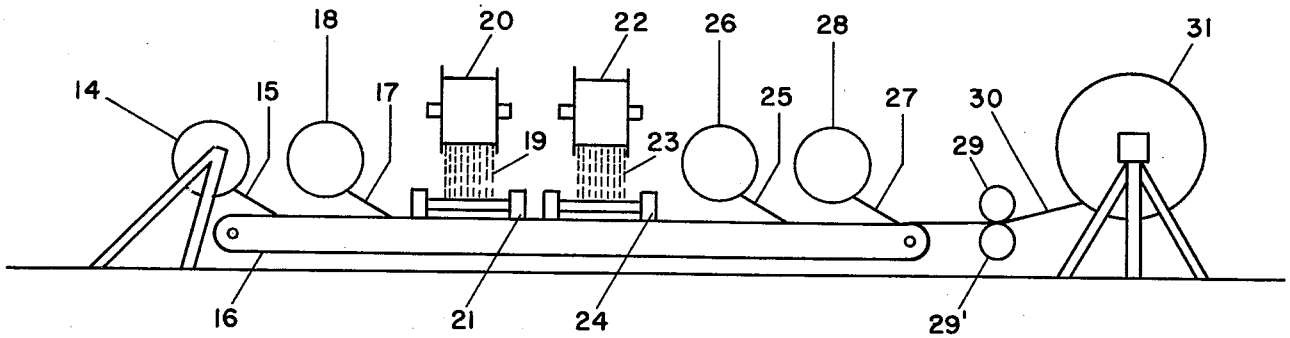
FIG. 2 is a schematic side view of the laminating apparatus.

In preparing the foam fibrillated webs of the present invention several extrusion and drawing techniques may be used. The drawings show the preferred technique. However for instance the extruder may be fed by any of a large number of alternate means including manually from sacks of pre-blended polypropylene and ethylene-vinyl acetate copolymer. For small runs a ram-type extruder can be used but obviously it is desired to operate more or less continuously and for this a screw-type extruder is preferred. A slit die has been shown and has been found most convenient for forming relatively narrow width webs of from say 6 inches to 5 feet. For wider webs of say 3 to 20 feet an annular die has obvious advantages. When using such an annular die the web is drawn over a mandrel to maintain or slightly increase its circumference, during orientation.

The extruder used may be equipped with a port to inject the blowing agent. If this is done, various blowing agents may be used such as the various Freons, methylene chloride, nitrogen, carbon dioxide, etc. If the extruder is not equipped with a port to inject the blowing agent the blowing agent is fed into the extruder along with the polymer blend. While this can be done by coating the polymer pellets with a low boiling liquid such as pentane which becomes a gas in the extruder it is preferred to blend a solid physically or chemically decomposable blowing agent with the polymers and then to feed the resulting blend into the extruder. Exemplary chemical agents include but are not limited to azobisformamide, azobisisobutyronitrile, diazoaminobenzene, 4,4′-oxybis(benzenesulfonylhydrazide), benzenesulfonylhydrazide, N,N′-dinitrosopentamethylenetetramine, trihydrazino-symtriazine, p,p′- oxybis(benzenesulfonylsemicarbazide)-4-nitrobenzene sulfonic acid hydrazide, beta-naphthalene sulfonic acid hydrazide, diphenyl-4,4'-di(sulfonylazide) and mixtures of materials such as sodium bicarbonate with a solid acid such as tartaric acid. The amount of foaming agent to be used in the process generally is in the range of from 0.1 to 20 wt. % of the polymer blend being extruded with from 0.1 to 5.0 wt. % being the preferred range.

The polypropylene used in the present process is isotactic polypropylene having a melt index of below 30 g. Almost any commercial polypropylene plastic is suitable whether it be molding, film or fiber grade.

The ethylene-vinyl acetate copolymer used in the present invention generally contains from 60 to 98 wt. % ethylene and from 2 to 40 wt. % vinyl acetate. Generally the polymer has a melt index of from 1 to 400 as determined by ASTM D-1238. The preferred melt index is from 1 to 20.

As the polypropylene-ethylene-vinyl acetate copolymer blend is extruded it is taken up by a take-up means such as a first pair of nip rolls and attenuated about 2 to 25 times. This attenuation serves to cause the foam bubbles forming within the die to break as the blend approaches the die resulting in a network or web of intertwined and connected fibrils. The temperature of the blend within the extruder is generally maintained at from 175° to 260°C, preferably 200°–235°C (die end of extruder). As the blend approaches the die lips it should be in the range of from 175° to 260°C, preferably 200° to 235°C. As the blend leaves the die lips it is quenched as with an air quench which serves to insure that the polymer blend is below 150°C which causes the foam bubbles which were forming as the pressure imposed on the polymer blend drops as the polymer blend approaches the lips of the die to rupture and form fibrils rather than merely to expand into larger bubbles. After this foam fibrillated web has been formed it is then stretched to orient the individual fibrils which make up the web thereby strengthening the web.

Generally the webs are drawn at a moderately elevated temperature. Suitable temperatures are from 90° to 150°C with from 120° to 140°C being the preferred range. The webs formed of the polypropylene-ethylene-vinyl acetate copolymer blend are considerably superior to webs formed of polypropylene alone with respect to their ability to be bonded to each other. When the blend contains about 15 wt. % of ethylene-vinyl acetate copolymer this bond strength is generally adequate without requiring the presence of additional adhesive. However the strongest webs are formed using from 2 to 15 wt. % ethylene-vinyl acetate copolymer and 98 to 85 wt. % polypropylene. Therefore it is preferred to use an adhesive. The adhesive can be a liquid which is sprayed, doctored or otherwise applied to whatever webs are to be assembled into a non-woven fabric. Any thermoplastic type adhesive which softens in the range of from 100° to 170°C can be used. A cross-linking type of adhesive can be used. Some ethylene-vinyl acetate formulations will cross link as will some acrylic systems. The commercially available ethylene-vinyl acetate copolymer emulsions are particularly satisfactory adhesives which can be applied. The assembly of webs is then laminated together by application of heat and pressure. In an especially preferred aspect of the invention the foam fibrillated webs are adhered together into a non-woven fabric by means of a film of thermoplastic having a softening point in the range of from 100° to 170°C. Particularly satisfactory films are polyethylene films and ethylene-vinyl acetate copolymer films wherein the copolymer contains from 15 to 40 wt. % vinyl acetate. Generally the die used has an opening from 15 to 25 mils in the thickness direction of the extrudate which results in the final oriented foam fibrillated webs weighing from 0.2 to 0.8 ounces per square yard. Generally the total thickness of however many adhesive films are used should be equal to from 0.1 to 0.7 mils per ounce per square yard of total foam fibrillated webs used in the final non-woven fabric.

The final non-woven fabric will normally contain from 3 to 20 layers. For most uses such as industrial bagging, primary carpet backing, secondary carpet backing, wallpaper, upholstery backing from 5 to 10 layers are used and the non-woven fabric product has a weight of from 2.5 to 10 ounces per square yard. There are a plurality of ways in which the layers of webs with or without the adhesive film can be assembled. Often the way in which the webs are assembled is dependent on the use to which the non-woven product is to be put. Usually this involves 2–4 layers in the machine direction and 2–4 lapped layers at an angle thereto. However, the webs can be run through a tenter frame to increase their width and impart a biaxial disposition to the direction of the individual fibrils within the web in which case all of the webs can be laid down in the machine direction and laminated.

For individual laminates of from say 6 inch square up to about 4 ft. × 8 ft. a press can be used to laminate the foam fibrillated webs together. Generally such a press is operated at from 10 to 500 p.s.i. and at 115° to 145°C. For long rolls of the non-woven product heated pressure rolls are used. Generally these are heated metal rolls fabricated from steel or coated steel operated at from 2 to 200 lbs. per lineal inch pressure, from 90° to 150°C and the material being laminated is fed at a rate of from 10 to 300 feet per minute. The hand, appearance, porosity and other physical characteristics of the non-woven product can be varied considerably by varying the severity of the laminating conditions within the parameters set forth above. Further these characteristics of the product non-woven fabric can be varied by using embossed or textured laminating rolls. If one (or if desired both) laminating rolls (or one surface of a press if such is being used) are covered with burlap or a screen of the appropriate size a non-woven fabric which looks like burlap can readily be obtained. This is a distinct advantage over other non-woven fabrics or even woven slit film in the production of secondary carpet backing where asthetics are important and burlap, which is now in short supply, has been the traditional material used.

The foam fibrillated webs of the present invention find uses other than in making non-woven fabrics. For instance a web from one-quarter to ten inches in width can be either twisted or false-twisted to form bailing twine useful as such. Further if desired a plurality of such bailing twines can be twisted to form a rope which approaches a conventional polypropylene fiber rope in properties such as strength even though such rope produced from the foam fibrillated web is considerably less expensive.

DESCRIPTION OF THE PREFERRED EMBODIMENTS

EXAMPLE I

A Killian 1 inch extruder having a 24:1 L/D screw is equipped with an 8 inch wide slit die having a 20 mil thick opening (Johnson Flex Lip coat hanger type die). The slit is offset from the screw by about 10 inches and extrudes in the same direction as the flow through the extruder barrel. The extruder hopper is continuously filled with the polymer blend reported in the Table. The extruder barrel is maintained at a feed end temperature of 175°C and a die end temperature of 232°C and the die at 232°C. The screw is operated at 24 rpm. Immediately adjacent the die lips is an air quench which is a pair of 0.5 inch diameter pipes one located above the die lips and the other below the die lips containing air under 80 p.s.i. line pressure. Each pipe contains a row of 0.030 inch diameter holes 0.125 inch apart directed at the extrudate. The extrudate is withdrawn from the die lips by a first pair of 5 inch diameter nip rolls 8 inches in width driven at a surface speed of 15 ft./minute to form a foam fibrillated web. These rolls comprise a driven rubber covered roll and a stainless steel idler roll. The foam fibrillated web is then passed over a heated shoe 8 inches wide and 36 inches long. The shoe is slightly arced in shape so as to maintain the foam fibrillated web in intimate contact with it. The shoe is maintained at 135°C. The foam fibrillated web is then passed between a second pair of nip rolls identical to the first pair of nip rolls and is then taken up by a take-up reel. In each of the examples reported in the Table the second pair of nip rolls are operated at the maximum speed which can be attained without web breakage, which results in the varying strength webs and varying stretch ratios reported. In each case the polymer blend contains 1 wt. % Celogen AZ (azodicarbonamide) blowing agent.

TABLE

| Composition | Maximum Stretch Ratio | Tenacity grams/denier |
|---|---|---|
| 100% Polypropylene (PP) | 3.33:1 | 1.50 |
| 75% PP — 25% EVA Copolymer | 3.26:1 | 1.16 |
| 90% PP — 10% EVA Copolymer | 3.35:1 | 1.55 |
| 75% PP — 25% Polyvinylchloride | 1.8:1 | .37 |
| 75% PP — 25% Acrylonitrile-Butadiene-Styrene Terpolymer | 1.3:1 | .20 |

It is obvious that ethylene-vinyl acetate copolymer (EVA) is a polymer which can be added to improve bonding without sacrificing the strength as is not the case with many similar materials, as shown above.

EXAMPLE II

The drawn foam fibrillated webs from 100% polypropylene and from 75% polypropylene-25% ethylene-vinyl acetate copolymer were cut into 8 inch lengths and fabricated by placing two webs side-by-side to form a layer, successive layers being laid to result in the primary fibrous structure being at right angles to each other in parallel planes. Samples containing six such layers were pressed at 140°C and 20,000 pounds pressure (~312.5 p.s.i.) for 5 minutes. The polypropylene sample had a basic weight of 2.40 oz./yd.$^2$ and a grab tensile strength (Federal Method 5100) of 35 pounds. The sample containing 25% ethylene-vinyl acetate copolymer had a basis weight of 2.80 oz./yd.$^2$ and a grab tensile strength of 55 pounds.

The invention claimed is:

1. A process of producing a foam fibrillated fibrous web comprising heating a blend of from 75 to 98 weight percent as based on said blend of isotactic polypropylene having a melt index below 30 and from 2 to 25 weight percent as based on said blend of ethylene-vinyl acetate copolymer containing from 60 to 98 weight percent ethylene and from 2 to 40 weight percent vinyl acetate and having a melt index from 1 to 400 in an extruder to from 175° to 260°C whereby a molten blend is formed, extruding said molten blend and from 0.1 to 20 percent by weight as based on said blend of a material which is gaseous under the extrusion conditions used mixed with said molten blend from a die into a zone of reduced pressure to produce an extrudate, quenching said extrudate to a temperature below about 150°C while withdrawing said extrudate from said die by a first linear take-up means at a linear rate of from 2 to 25 times the linear rate at which said blend reaches the lips of said die whereby the foam cells forming are ruptured and a foam fibrillated web is formed, and stretching said foam fibrillated web from 1.5 to 10 times in the machine direction at a temperature of from about 90°C to about 150°C to increase the strength thereof.

2. The process of claim 1 wherein from 0.1 to 5.0 percent by weight of said gaseous material is used.

3. The process of claim 2 wherein the die opening is from about 15 to about 25 mils in the thickness direction.

4. The process of claim 3 wherein the blend contains about 10 weight percent ethylene-vinyl acetate copolymer and the fibrillated web is stretched about 3.35 times.

* * * * *